US011873600B2

(12) United States Patent
Holzen et al.

(10) Patent No.: US 11,873,600 B2
(45) Date of Patent: Jan. 16, 2024

(54) WASHING MACHINE TUB COVER

(71) Applicant: Haier US Appliance Solutions, Inc., Wilmington, DE (US)

(72) Inventors: Thomas Holzen, Louisville, KY (US); Todd Anthony Reger, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/686,604

(22) Filed: Mar. 4, 2022

(65) Prior Publication Data

US 2023/0279604 A1 Sep. 7, 2023

(51) Int. Cl.

| | |
|---|---|
| ***D06F 37/28*** | (2006.01) |
| ***D06F 37/26*** | (2006.01) |
| ***D06F 23/04*** | (2006.01) |

(52) U.S. Cl.

CPC ..... *D06F 37/28* (2013.01); *D06F 23/04* (2013.01); *D06F 37/267* (2013.01)

(58) Field of Classification Search

None

See application file for complete search history.

(56) References Cited

U.S. PATENT DOCUMENTS

| | | | | |
|---|---|---|---|---|
| 3,390,554 | A * | 7/1968 | Morgan | D06F 37/266 68/23 R |
| 5,377,508 | A * | 1/1995 | Hair | D06F 37/12 68/4 |
| 7,263,864 | B2 | 9/2007 | Lyu et al. | |
| 2011/0148260 | A1 | 6/2011 | Silva | |

FOREIGN PATENT DOCUMENTS

| | | |
|---|---|---|
| CN | 108729122 A | 11/2018 |
| KR | 100802473 B1 | 2/2008 |

OTHER PUBLICATIONS

KR 100802473 B1 translation, Tub assembly and washing machine having the same, Ha (Year: 2008).*

* cited by examiner

*Primary Examiner* — Cristi J Tate-Sims

(74) *Attorney, Agent, or Firm* — Dority & Manning, P.A.

(57) ABSTRACT

A washer tub assembly that includes a washer tub, a basket mounted inside the washer tub, and a tub cover. The tub cover coupled to the washer tub at a top portion of the washer tub over the basket, and the tub cover defines a slot. A rim of the washer tub is disposed within the slot and included is a protrusion positioned in the slot between the rim and the tub cover. The protrusion configured to deform one or both of the washer tub and the tub cover along the vertical direction.

20 Claims, 6 Drawing Sheets

WASHING MACHINE TUB COVER

FIELD OF THE INVENTION

The present subject matter relates generally to tub covers in washing machines.

BACKGROUND OF THE INVENTION

Washing appliances (also referred to as "washing machines") typically include a drum or basket assembly for receipt of articles to be washed. This basket assembly is placed within a washer bin or washer tub that serves as a container for various fluids applied to the articles during a cleaning cycle. The basket assembly typically includes small openings or holes for the passage of fluid in and out of the basket during the cleaning cycle. Conventionally, there is a gap between the washer tub and the basket assembly so that the various fluids applied to the articles during a cleaning cycle have passage in and out of the basket.

The gap may additionally provide a pathway for the articles being washed in the appliance to get stuck in between the washer tub and basket assembly. A tub cover may be used to block contents from entering the gap between the tub and basket assembly. Washing machines undergo operation in a variety of scenarios, often with loads of various stability. With loads of varying stability, the operation of the washing machine may lead to vibrations and noise.

BRIEF DESCRIPTION OF THE INVENTION

Aspects and advantages of the invention will be set forth in part in the following description, or may be apparent from the description, or may be learned through practice of the invention.

In one example embodiment, a washer tub assembly includes a washer tub, a basket mounted inside the washer tub, and a tub cover. The tub cover coupled to the washer tub at a top portion of the washer tub over the basket, and the tub cover defines a slot. A rim of the washer tub is disposed within the slot and included is a protrusion positioned in the slot between the rim and the tub cover. The protrusion configured to deform one or both of the washer tub and the tub cover along the vertical direction.

A washer tub assembly including a washer tub with a mounting post extending radially from a cylindrical wall of the washer tub, and a basket mounted inside the washer tub. Additionally included is a tub cover coupled to the washer tub at a top portion of the washer tub over the basket. The tub cover includes a mounting loop that defines an opening. The mounting post of the washer tub is received within the mounting loop of the tub cover in order to couple the tub cover to the washer tub. A protrusion is disposed between the rim and the tub cover, and the protrusion is configured to deform one or both of the washer tub and the tub cover along the vertical direction such that opposing surfaces of the mounting post and the mounting loop contact each other.

A washer tub assembly including a washer tub with a mounting post extending radially from a cylindrical wall of the washer tub, and a basket mounted inside the washer tub. Additionally included is a tub cover coupled to the washer tub at a top portion of the washer tub over the basket. The tub cover includes a mounting loop that defines an opening. The mounting post of the washer tub is received within the mounting loop of the tub cover in order to couple the tub cover to the washer tub. The coupling of the mounting loop and the mounting post defines a fit-clearance. Additionally, included is a slot defined by the tub cover where a rim of the washer tub is disposed within the slot. A protrusion is also disposed in the slot of the tub cover. The rim of the washer tub is disposed within the slot where the protrusion is configured to deform one or both of the washer tub and the tub cover along the vertical direction such that opposing surfaces of the mounting post and the mounting loop contact each other.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
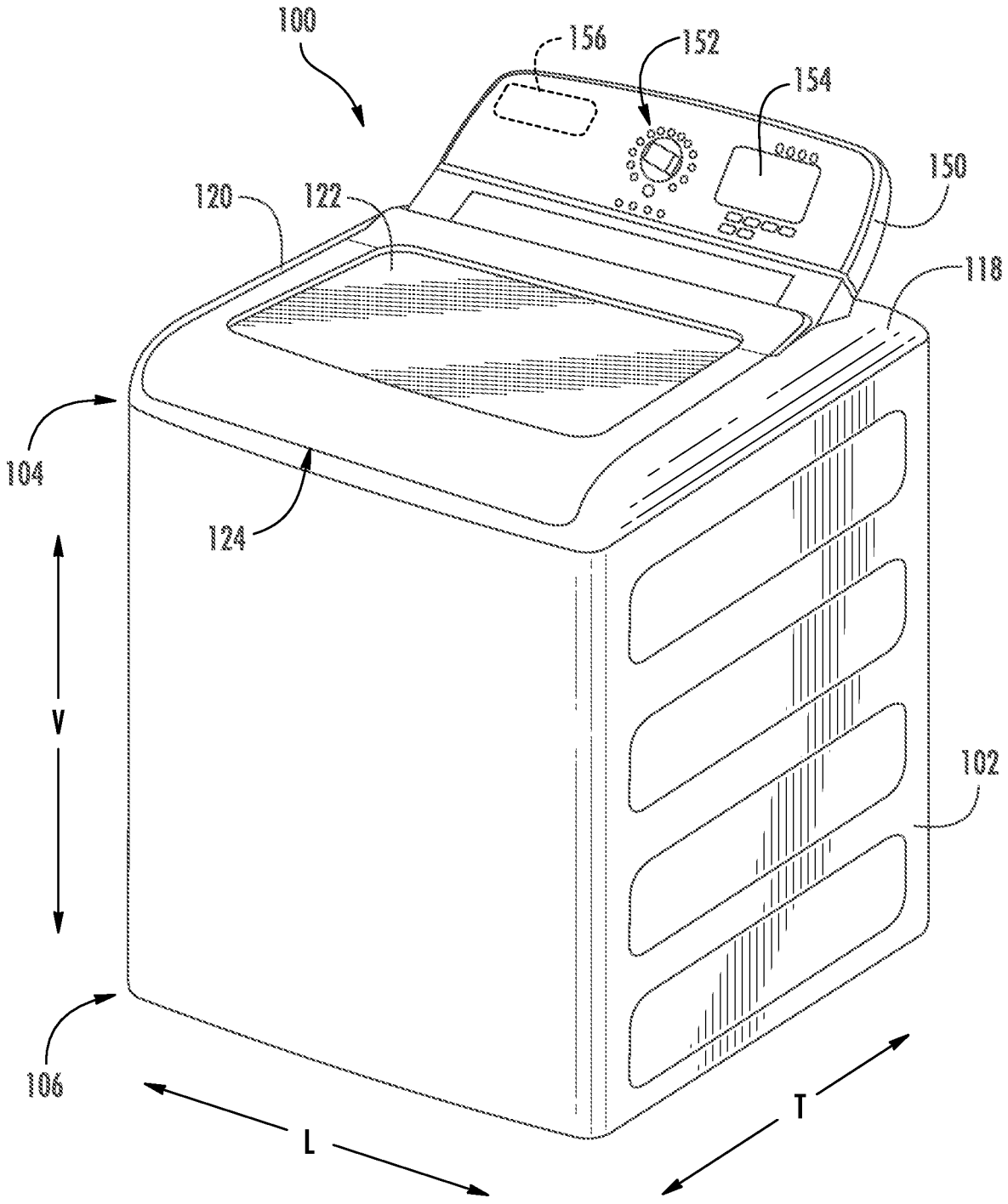
FIG. 1 is a perspective view of a washer appliance according to an example embodiment of the present subject matter.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a ten percent (10%) margin.

Figure 2:
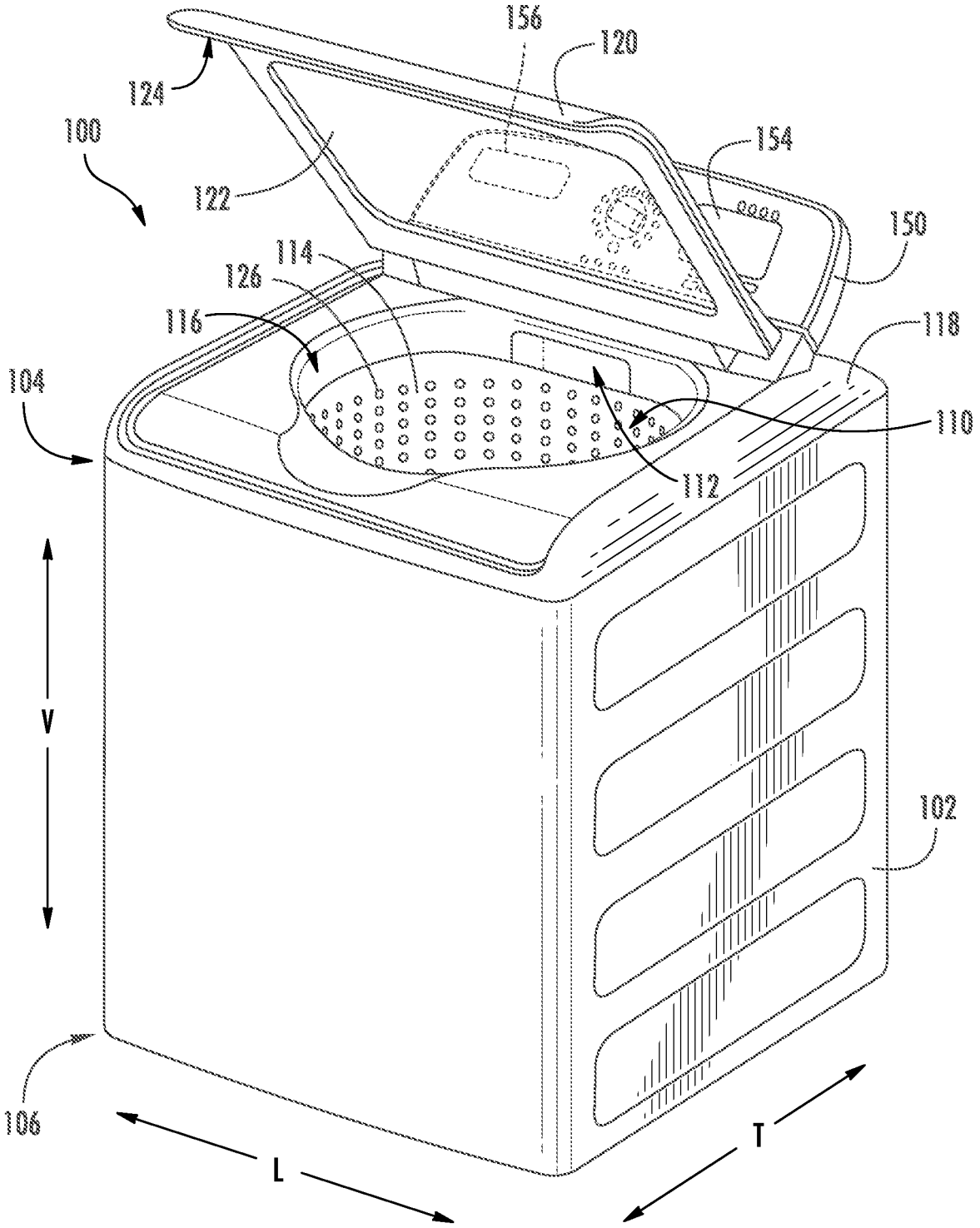
FIG. 2 is a perspective view of an open configuration of the example washer appliance of FIG. 1.
Figure 3:
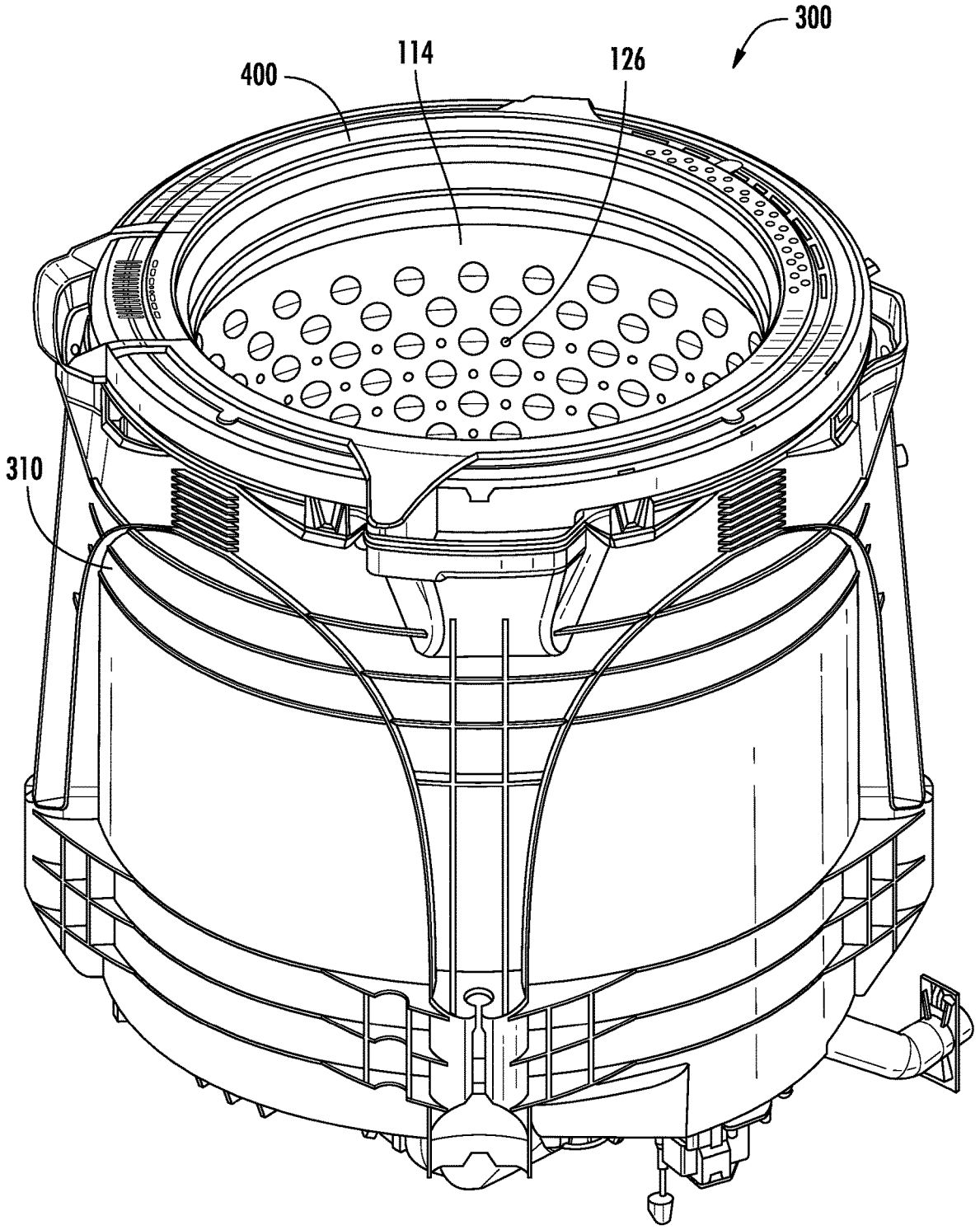
FIG. 3 is a perspective view of a tub assembly of FIG. 2.

FIGS. 1 and 2 illustrate an example embodiment of a vertical axis washing machine appliance 100. Specifically, FIGS. 1 and 2 illustrate perspective views of washing machine appliance 100 in a closed and an open position, respectively. FIG. 3 illustrates an example embodiment of a washer tub assembly 300. Washing machine appliance 100 generally defines a vertical direction V, a lateral direction L, and a transverse direction T, which are mutually perpendicular, such that an orthogonal coordinate system is generally defined.

While described in the context of a specific embodiment of vertical axis washing machine appliance 100, it should be appreciated that vertical axis washing machine appliance 100 is provided by way of example only. Indeed, modifications and variations may be made to washing machine appliance 100, including different configurations, different appearances, and/or different features while remaining within the scope of the present subject matter.

Figure 4:
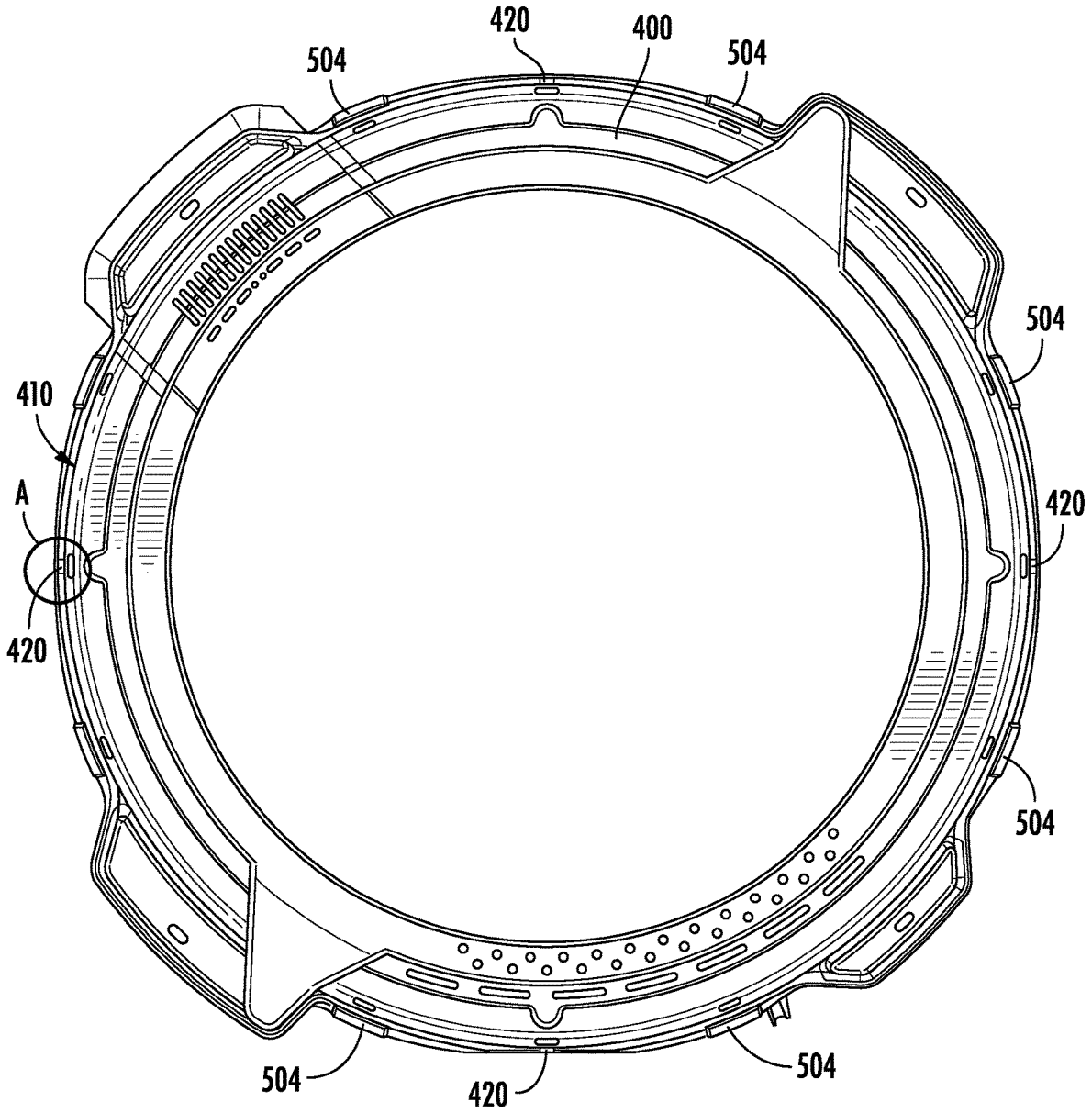
FIG. 4 is a bottom, plan view of a tub cover of FIG. 3.

Washing machine appliance 100 has a cabinet 102 that extends between a top portion 104 and a bottom portion 106 along the vertical direction V, between a first side (left) and a second side (right) along the lateral direction L, and between a front and a rear along the transverse direction T. As best shown in FIG. 3, washer tub assembly 300 is positioned within cabinet 102, defined by a washer tub 310, a basket 114, as well as a tub cover 400 (FIG. 4). Washer tub assembly 300 is generally configured for retaining wash fluids during an operating cycle. Washing machine appliance 100 further includes a primary dispenser (not shown) for dispensing wash fluid into washer tub assembly 300. The term "wash fluid" refers to a liquid used for washing and/or rinsing articles during an operating cycle and may include any combination of water, detergent, fabric softener, bleach, and other wash additives or treatments.

In addition, washing machine appliance 100 includes basket 114 that is positioned within washer tub assembly 300 and generally defines an opening 116 for receipt of articles for washing. More specifically, basket 114 is rotatably mounted within washer tub assembly 300 such that it is rotatable about the vertical axis. In this regard, washing machine appliance 100 is generally referred to as a "vertical-axis" or "top load" washing machine appliance 100.

As illustrated, cabinet 102 of washing machine appliance 100 has a top panel 118. Top panel 118 defines an opening (FIG. 2) that coincides with opening 116 of basket 114 to permit a user access to basket 114. Washing machine appliance 100 further includes a door 120 which is rotatably mounted to top panel 118 to permit selective access to opening 116. In particular, door 120 selectively rotates between the closed position (as shown in FIG. 1) and the open position (as shown in FIG. 2). In the closed position, door 120 inhibits access to basket 114. Conversely, in the open position, a user can access basket 114. A window 122 in door 120 permits viewing of basket 114 when door 120 is in the closed position, e.g., during operation of washing machine appliance 100. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, basket 114 further defines a plurality of perforations 126 to facilitate fluid communication between an interior of basket 114 and washer tub 310. In this regard, basket 114 is spaced apart from washer tub 310 to define a space for wash fluid to escape wash chamber 110. During a spin cycle, wash fluid within articles of clothing and within wash chamber 110 is urged through perforations 126.

Referring to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of washing machine appliance 100 is controlled by a controller 156 that is operatively coupled to control panel 150 for user manipulation to select washing machine cycles and features. In response to user manipulation of control panel 150, controller 156 operates the various components of washing machine appliance 100 to execute selected machine cycles and features. According to an exemplary embodiment, controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of washing machine appliance 100 may be in communication with controller 156 via one or more signal lines or shared communication busses.

During operation of washing machine appliance 100, laundry items are loaded into basket 114 through opening 116, and washing operation is initiated through operator manipulation of input selectors 152. Basket 114 is filled with water and detergent and/or other fluid additives via a primary dispenser (not shown). One or more valves can be controlled by washing machine appliance 100 to provide for filling washer tub 310 and basket 114 to the appropriate level for the amount of articles being washed and/or rinsed. By way of example for a wash mode, once basket 114 is properly filled with fluid, the contents of basket 114 can be agitated for washing of laundry items in basket 114.

Figure 5:
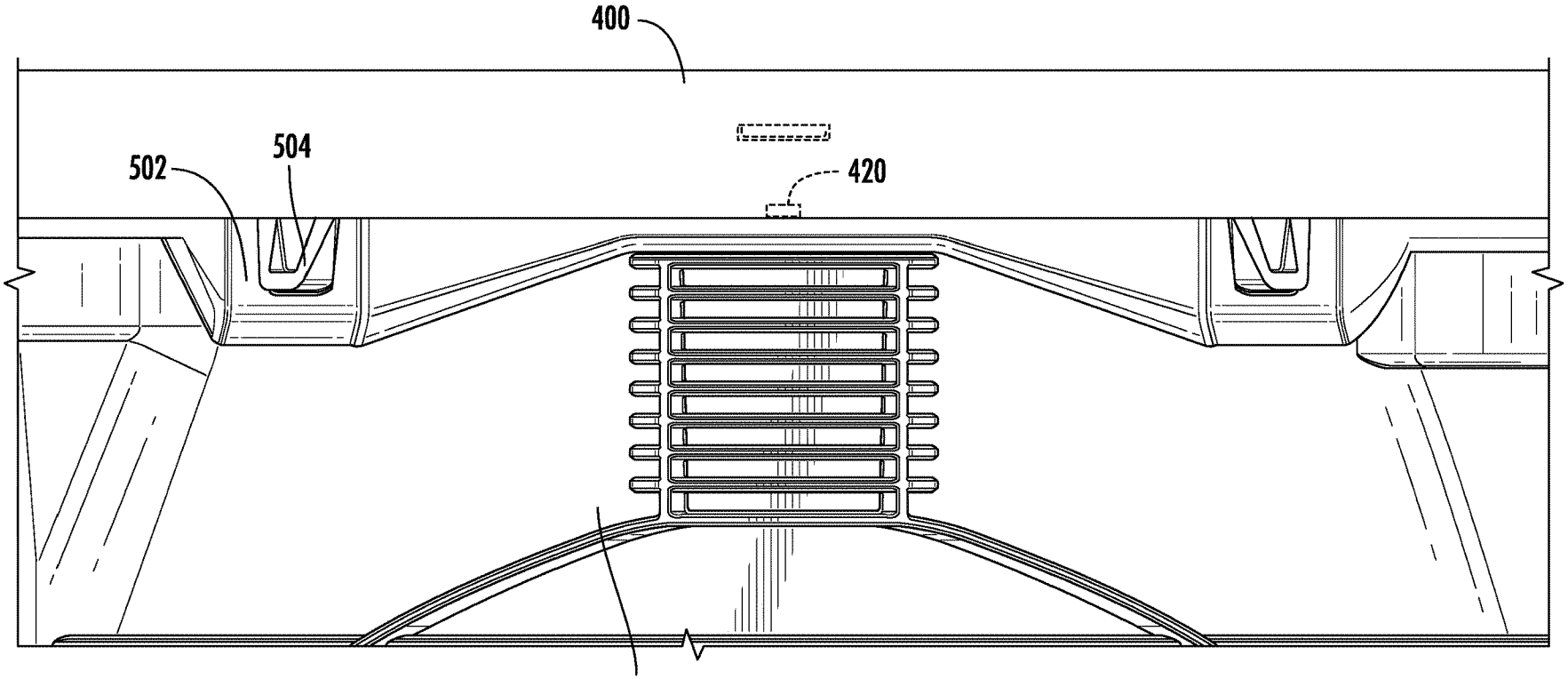
FIG. 5 is a partial side, elevation view the tub cover connection to the tub assembly of FIG. 3.

Referring now to FIGS. 4 and 5, shown in FIG. 4 is the underside, or bottom, of tub cover 400. The bottom of tub cover 400 may have a slot 410, which guides the joining of tub cover 400 with washer tub 310. Slot 410 may extend circumferentially around tub cover 400, and a top edge or rim of washer tub 310 may be received within slot 410 when tub cover 400 is mounted to washer tub 310. Tub cover 400 may prevent articles of laundry from entering the space between washer tub 310 and basket 114. As may be seen in FIG. 5, tub cover 400 utilizes loops paired with matching flanges on washer tub 310 to couple tub cover 400 and washer tub 310 together. Thus, tub cover 400 and washer tub 310 may utilize mounting loop 502 and mounting post 504, respectively, as a snap-fit fastener in order to couple tub cover 400 with washer tub 310. The assembly of tub cover 400 with washer tub 310 may be difficult for a user when the snap-fit clearance is tight. In order reduce the difficulty of assembling tub cover 400 with washer tub 310, fit-clearance may be added such that there may be a small gap around mounting post 504 where mounting post 504 matches up and engages with or contacts mounting loop 502. Since there may be a small gap at each area where mounting post 504 matches up with mounting loop 502, noise may be generated between washer tub 310 and tub cover 400 due to vibrations while washing machine appliance 100 is operating. Tub cover 400 and/or washer tub 310 may include features for reducing such noise.

Figure 6:
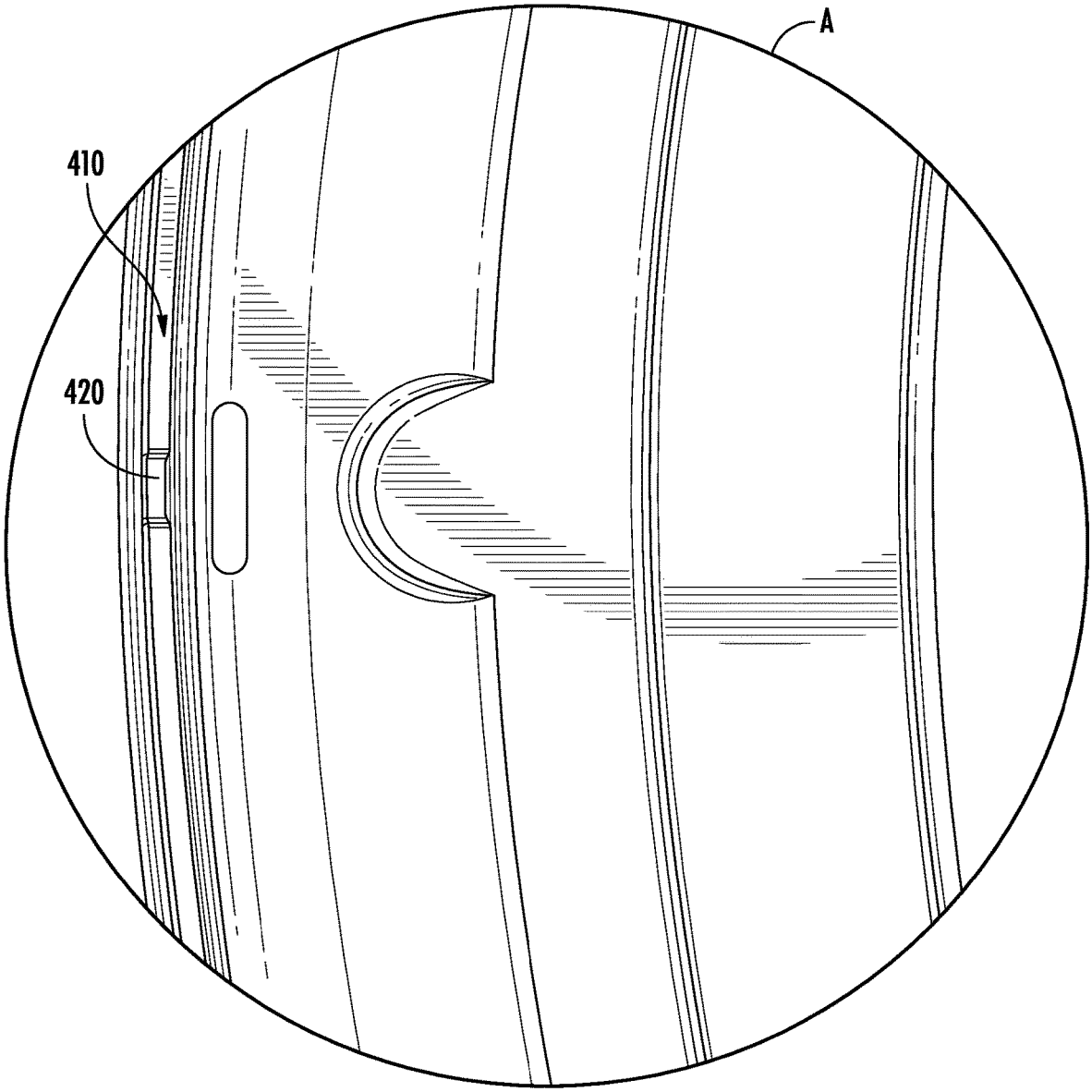
FIG. 6 is a bottom view of section-A from FIG. 4.

To reduce the vibration and noise generated by the operation of washing machine appliance 100, a protrusion 420 may be added to tub cover 400. As shown in FIG. 6, protrusion 420 may be positioned in slot 410. Referring back to FIG. 5, protrusion 420 may contact the top-side or edge of washer tub 310. The contact of protrusion 420 on the top-side of washer tub 310 may flex tub cover 400 between protrusion 420 and mounting loop 502, creating tension in the vertical direction V. In other words, the flex or elastic deformation of tub cover 400 created by protrusion 420 contacting the top-side of washer tub 310 causes the opposing surfaces of mounting post 504 and mounting loop 502 to contact each other. The tension therefor may hold tub cover 400 with force against washer tub 310, reducing the vibration and thus the noise created during the operation of washing machine appliance 100.

Protrusion 420 may be positioned equidistant, e.g., circumferentially, from the plurality of mounting loop 502 on tub cover 400. An example tub cover 400 may have four (4) protrusions 420, each spaced equidistant between a respective one of four (4) sets of two (2) mounting loop 502. As may be seen in FIG. 4, the provided example tub cover 400 has (4) protrusions 420, spaced equidistant between four (4) sets of two (2) mounting loop 502 as described above. Having protrusion 420 equally spaced around the circumference of tub cover 400 creates a balanced amount of force between tub cover 400 and washer tub 310, and thus increasing stability. Additionally, a length of protrusion 420, e.g., along the axis of basket 114 and/or the vertical direction V, may be no less than two millimeters (2 mm) and no greater than ten millimeters (10 mm). Moreover, a circumferential width of protrusion 420 may be no less than five millimeters (5 mm) and no greater than twenty-five millimeters (25 mm). Further, a radial depth of protrusion 420 may be no less than one millimeter (1 mm) and no greater than four millimeters (4 mm). It will be understood that the sizing of protrusion 420 may vary from the specific examples provided above in certain example embodiments.

While described in the context of a specific embodiment of washing machine appliance 100, using the teachings disclosed herein it will be understood that washing machine appliance 100 is provided by way of example only. Other washing machine appliances having different configurations, different appearances, and/or different features may also be utilized with the present subject matter as well, including horizontal-axis washing machine appliances. In addition, aspects of the present subject matter may be utilized in a combination washer/dryer appliance.

As may be seen from the above, basket 114 is housed within washer tub 310 and tub cover 400. Basket 114 is mounted within washer tub 310, and then tub cover 400 is mounted on the top-side of washer tub 310. Washer tub assembly 300 may be suspended inside washing machine appliance 100, and basket 114 may rotate with loads of various articles, which depending upon the arrangement of the articles in washer tub assembly 300, may cause washer tub assembly 300 to vibrate with respect to washing machine appliance 100. The vibration may cause tub cover 400 to move with respect to washer tub 310 which may result in noise being produced. Protrusion 420 in slot 410 of tub cover 400 creates an axial force between tub cover 400 and washer tub 310, reducing noise made by the vibrations of washer tub assembly 300. In other words, the relative motion of washer tub 310 to tub cover 400 may be limited or arrested, and the produced noise may be reduced.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washer tub assembly, comprising:

a washer tub;

a basket mounted inside the washer tub;

a tub cover coupled to the washer tub at a top portion of the washer tub over the basket, the tub cover defining a slot, the slot positioned in the bottom of the tub cover, a rim of the washer tub disposed within the slot; and a protrusion positioned in the slot between the rim and the tub cover, the protrusion configured to deform one or both of the washer tub and the tub cover along the vertical direction.

2. The washer tub assembly of claim 1, wherein the tub cover comprises a loop, which removably couples to a flange positioned on the washer tub, the loop and the flange provided in a plurality of pairs spaced apart from each other.

3. The washer tub assembly of claim 1, wherein the tub cover comprises a flange, which removably couples to a loop positioned on the washer tub, the loop and the flange provided in a plurality of pairs spaced apart from each other.

4. The washer tub assembly of claim 1, wherein the washer tub assembly is configured for use in a vertical-axis washing machine.

5. The washer tub assembly of claim 2, wherein the protrusion is set circumferentially equidistant between each of the plurality of pairs of the loop and the flange.

6. The washer tub assembly of claim 1, wherein the protrusion is formed on the tub cover.

7. The washer tub assembly of claim 1, wherein the protrusion is formed on the washer tub.

8. The washer tub assembly of claim 1, wherein a vertical length of the protrusion, is no less than two millimeters (2 mm) and no greater than ten millimeters (10 mm).

9. The washer tub assembly of claim 1, wherein a circumferential width of the protrusion is no less than five millimeters (5 mm) and no greater than twenty-five millimeters (25 mm).

10. The washer tub assembly of claim 1, wherein a radial depth of the protrusion is no less than one millimeter (1 mm) and no greater than four millimeters (4 mm).

11. The washer tub assembly of claim 1, wherein the wash tub assembly comprises no more than four (4) protrusions.

12. A washer tub assembly, comprising:

a washer tub with a mounting post extending radially from a cylindrical wall of the washer tub;

a basket mounted inside the washer tub;

a tub cover coupled to the washer tub at a top portion of the washer tub over the basket, the tub cover comprising a mounting loop defining an opening, the mounting post of the washer tub received within the mounting loop of the tub cover in order to couple the tub cover to the washer tub, the tub cover defining a slot, a rim of the washer tub disposed within the slot; and a protrusion disposed between the rim and the tub cover, the protrusion configured to deform one or both of the washer tub and the tub cover along the vertical direction such that opposing surfaces of the mounting post and the mounting loop contact each other, the washer tub assembly comprising no more than four (4) protrusions.

13. The washer tub assembly as in claim 12, wherein the washer tub assembly is configured for use in a vertical-axis washing machine.

14. The washer of claim 12, wherein the protrusion is set circumferentially equidistant between the mounting loop.

15. The washer tub assembly of claim 12, wherein the protrusion is formed on the tub cover.

16. The washer tub assembly of claim 12, wherein the protrusion is formed on the washer tub.

17. The washer tub assembly of claim 12, wherein the slot is positioned in the bottom of the tub cover.

18. A washer tub assembly, comprising:

a washer tub with a mounting post extending radially from a cylindrical wall of the washer tub;

a basket mounted inside the washer tub;

a tub cover coupled to the washer tub at a top portion of the washer tub over the basket, the tub cover comprising a mounting loop defining an opening, the mounting post of the washer tub received within the mounting loop of the tub cover in order to couple the tub cover to the washer tub, the coupling of the mounting loop and the mounting post defining a fit-clearance;

a slot defined by the tub cover, a rim of the washer tub disposed within the slot; and a protrusion disposed in the slot of the tub cover, the rim of the washer tub disposed within the slot; the protrusion configured to deform one or both of the washer tub and the tub cover along the vertical direction such that opposing surfaces of the mounting post and the mounting loop contact each other, wherein a vertical length of the protrusion, is no less than two millimeters (2 mm) and no greater than ten millimeters (10 mm), a circumferential width of the protrusion is no less than five millimeters (5 mm) and no greater than twenty-five millimeters (25 mm), and a radial depth of the protrusion is no less than one millimeter (1 mm) and no greater than four millimeters (4 mm).

19. The washer tub assembly of claim 18, wherein the slot is positioned in the bottom of the tub cover.

20. The washer tub assembly of claim 18, wherein the wash tub assembly comprises no more than four (4) protrusions.

* * * * *